US008021124B2

(12) United States Patent
Umemura et al.

(10) Patent No.: US 8,021,124 B2
(45) Date of Patent: Sep. 20, 2011

(54) CAPACITY CONTROL VALVE

(75) Inventors: Satoshi Umemura, Aichi (JP); Masaki Ota, Aichi (JP); Masahiro Kawaguchi, Aichi (JP); Ryosuke Cho, Tokyo (JP); Keigo Shirafuji, Tokyo (JP); Toshiaki Iwa, Tokyo (JP)

(73) Assignees: Eagle Industry Co., Ltd., Aichi (JP); Kabushiki Kaisha Toyota Jidoshokki, Aichi (JP)

( * ) Notice: Subject to any disclaimer, the term of this patent is extended or adjusted under 35 U.S.C. 154(b) by 949 days.

(21) Appl. No.: 11/884,838

(22) PCT Filed: Feb. 23, 2006

(86) PCT No.: PCT/JP2006/003231

§ 371 (c)(1),
(2), (4) Date: Dec. 13, 2007

(87) PCT Pub. No.: WO2006/090760

PCT Pub. Date: Aug. 31, 2006

(65) Prior Publication Data

US 2008/0138213 A1 Jun. 12, 2008

(30) Foreign Application Priority Data

Feb. 24, 2005 (JP) ..... 2005-049575

(51) Int. Cl.
*F04B 1/26* (2006.01)
*F16K 31/00* (2006.01)

(52) U.S. Cl. ..... 417/222.2; 251/333

(58) Field of Classification Search ..... 417/222.2, 417/222.1, 269; 137/508, 596.2, 630.22, 137/625.17; 251/129.03, 333
See application file for complete search history.

(56) References Cited

U.S. PATENT DOCUMENTS

| | | | | |
|---|---|---|---|---|
| 4,685,866 | A | 8/1987 | Takenaka et al. | |
| 4,688,997 | A | 8/1987 | Suzuki et al. | |
| 4,932,434 | A * | 6/1990 | Taylor | 137/469 |
| 6,113,066 | A * | 9/2000 | Hohl et al. | 251/129.02 |
| 6,354,811 | B1 | 3/2002 | Ota et al. | |
| 6,715,700 | B2 * | 4/2004 | Okamura et al. | 239/585.4 |

(Continued)

FOREIGN PATENT DOCUMENTS

| | | |
|---|---|---|
| JP | 61-286591 | 12/1986 |

(Continued)

*Primary Examiner* — Devon C Kramer
*Assistant Examiner* — Leonard Weinstein
(74) *Attorney, Agent, or Firm* — Wenderoth, Lind & Ponack, L.L.P.

(57) ABSTRACT

A capacity control valve includes a valve body having a first valve portion for opening/closing a discharge-side path and a second valve portion for opening/closing a suction-side path, a pressure sensitive body arranged in a third valve chamber in the middle of the suction-side path, a valve seat body provided at the pressure sensitive body, and a third valve portion connected to the valve body for opening/closing the suction-side path by engagement and disengagement with the valve seat body. One of an engagement face of the third valve portion and a seat face of the valve seat body is formed into a spherical shape with a radius of curvature R satisfying 9 mm<R<11 mm and the other of the engagement face of the third valve portion and the seat face of the valve seat body is formed into a tapered surface shape having a center angle α satisfying 120°<α<160°. As such, a liquid refrigerant or the like accumulating in the control chamber can be discharged efficiently, and predetermined capacity control can be carried out rapidly.

18 Claims, 9 Drawing Sheets

U.S. PATENT DOCUMENTS

| | | | | |
|---|---|---|---|---|
| 6,772,990 | B2 | 8/2004 | Sasaki et al. | |
| 6,835,053 | B2 * | 12/2004 | Utsumi | 417/569 |
| 2002/0179874 | A1 * | 12/2002 | Hofmann et al. | 251/129.15 |
| 2003/0145615 | A1 | 8/2003 | Sasaki et al. | |
| 2003/0151018 | A1 * | 8/2003 | Teshima et al. | 251/332 |
| 2004/0051072 | A1 * | 3/2004 | Hardin | 251/333 |

FOREIGN PATENT DOCUMENTS

| | | |
|---|---|---|
| JP | 2001-132632 | 5/2001 |
| JP | 2003-322086 | 11/2003 |

* cited by examiner

CAPACITY CONTROL VALVE

BACKGROUND OF THE INVENTION (1) Field of the Invention

The present invention relates to a capacity control valve for variable control of a capacity or pressure of a working fluid and particularly to a capacity control valve for controlling a discharge amount of a variable capacity compressor or the like used in an air-conditioning system of an automobile or the like according to a pressure load.

(2) Description of Related Art

A swash-plate type variable capacity compressor used in an air-conditioning system of an automobile or the like is provided with a rotating shaft rotated and driven by a rotation force of an engine, a swash plate connected to the rotating shaft with a variable inclination angle, a piston for compression connected to the swash plate and the like, and by varying the inclination angle of the swash plate, a stroke of the piston is changed so as to control the discharge amount of a refrigerant gas.

The inclination angle of the swash plate can be continuously changed by adjusting a pressure balance acting on both faces of the piston through appropriate control of a pressure in a control chamber using a capacity control valve opening/closing-driven by an electromagnetic force while using a suction pressure of a suction chamber suctioning a refrigerant gas, a discharge pressure of a discharge chamber discharging the refrigerant gas pressurized by a piston, and a control chamber pressure of the control chamber (crank chamber) accommodating the swash plate.

As this type of capacity control valve, such a valve is known that is provided with a discharge-side path for having a discharge chamber communicate with a control chamber, a first valve chamber formed in the middle of the discharge-side path, a suction-side path for having a suction chamber communicate with the control chamber, a second valve chamber (operation chamber) formed in the middle of the suction-side path, a valve body formed so that a first valve portion arranged in the first valve chamber for opening/closing the discharge-side path and a second valve portion arranged in the second valve chamber for opening/closing the suction-side path are integrally reciprocated and carry out opening/closing operation in the opposite direction to each other, a third valve chamber (capacity chamber) formed close to the control chamber in the middle of the suction-side path, a pressure sensitive body (bellows) arranged in the third valve chamber, applying an urging force in a direction for extension (expansion) and contracting with increase of the surrounding pressure, a valve seat body (engagement portion) provided at a free end in the expansion/contraction direction of the pressure sensitive body and having a ring-like seat face, a third valve portion (opening-valve connection portion) capable of integrally moving with the valve body in the third valve chamber and opening/closing the suction-side path by engagement/disengagement with/from the valve seat body, a solenoid for applying an electromagnetic driving force to the valve body and the like (See Patent Document 1, for example).

In this capacity control valve, even though a clutch mechanism is not provided at the variable capacity compressor at capacity control, if the control chamber pressure needs to be changed, the pressure in the control chamber (control chamber pressure) can be adjusted by having the discharge chamber communicate with the control chamber. Also, if the control chamber pressure is raised while the variable capacity compressor is stopped, the third valve portion (opening valve connection portion) is disengaged from the valve seat body (engagement portion) so as to open the suction-side path, and the suction chamber is made to communicate with the control chamber.

When the swash plate type variable capacity compressor is stopped, and left for a long time before being started again, a liquid refrigerant (a refrigerant gas cooled during it is left and liquefied) accumulates in the control chamber (crank chamber), and a desired discharge amount can not be ensured by compressing the refrigerant gas unless this liquid refrigerant is discharged.

Thus, in order to provide a desired capacity control immediately after start, this liquid refrigerant should be discharged as rapidly as possible, but in the above conventional capacity control valve, when the suction-side path for having the control chamber communicate with the suction chamber is opened, a relation between the path area formed between the third valve portion (opening valve connection portion) and the valve seat body (engagement portion) and a flow rate is not considered. Therefore, the flow rate of the liquid refrigerant flowing while the third valve portion is opened is small, and a long time is required until the liquid refrigerant is discharged from the control chamber (crank chamber) and secure capacity control can be executed.

Patent Document 1: Unexamined Japanese Patent Publication No. 2003-322086

BRIEF SUMMARY OF THE INVENTION

Problem to be Solved by the Invention

The present invention was made in view of the above circumstances and particularly has an object to provide a capacity control valve which can rapidly execute a desired capacity control by heightening a discharge performance of a liquid refrigerant from a control chamber immediately after start of a variable capacity compressor, realize stable capacity control and reduce size, costs and the like.

Means for Solving the Problem

In order to achieve the above object, a capacity control valve of the present invention includes a discharge-side path for having a discharge chamber discharging a fluid communicate with a control chamber for controlling a discharge amount of the fluid, a first valve chamber formed in the middle of the discharge-side path, a suction-side path for having a suction chamber suctioning the fluid communicate with the control chamber, a second valve chamber formed in the middle of the suction-side path, a valve body integrally having a first valve portion for opening/closing the discharge-side path in the first valve chamber and a second valve portion for opening/closing the suction-side path in the second valve chamber and carrying out opening/closing operation opposite to each other by their reciprocating motion, a third valve chamber formed close to the control chamber rather than the second valve chamber in the middle of the suction-side path, a pressure sensitive body arranged in the third valve chamber, applying an urging force in a direction to open the first valve portion by its expansion and contracting with increase in pressure of the surroundings, a valve seat body provided at a free end in an expansion/contraction direction of the pressure sensitive body and having a ring-like seat face, a third valve portion moving integrally with the valve body in the third valve chamber and having a ring-like engagement face opening/closing the suction-side path by engagement and disengagement with the seat face of the valve seat body, and a solenoid applying an electromagnetic driving force in a direction to close the first valve portion with respect to the valve body, and one of the engagement face of the third valve portion and the seat face of the valve seat body is formed into a spherical shape and the other of the engagement face of the third valve portion and the seat face of the valve seat body is formed into a tapered surface shape having a center angle $\alpha$ satisfying $120° < \alpha < 160°$.

According to this configuration, in the normal capacity control state, when the solenoid is driven so as to generate a predetermined electromagnetic force, while the third valve portion is engaged with the valve seat body and closed, the first valve portion and the second valve portion are opened/closed appropriately so as to adjust the control chamber pressure for capacity control so that a predetermined discharge amount is obtained.

Here, when the variable capacity compressor is left in a stopped state for a long time while the solenoid is turned off and the second valve portion closes the suction-side path, the liquid refrigerant accumulates in the control chamber and the control chamber pressure rises, the control chamber pressure contracts the pressure sensitive body and disengages the third valve portion from the valve seat body so as to bring it into a valve-opened state. And when the solenoid is turned on and the valve body starts to be operated, the first valve portion is moved to the valve-closing direction and the second valve portion is moved to the valve-opening direction.

When the suction-side path is in the opened state, the liquid refrigerant in the control chamber is discharged from the suction-side path into the suction chamber. At this time, since the other of the engagement face of the third valve portion and the seat face of the valve seat body is formed into a tapered surface shape with the center angle $\alpha$ satisfying the above condition, the liquid refrigerant is discharged efficiently and transition to a desired capacity control can be made rapidly. On the other hand, when the third valve portion is engaged with the valve seat body and closed, an aligning action can be obtained and secure closing (sealing) state can be obtained.

In the above configuration, such a configuration may be employed that one of the engagement face of the third valve portion and the seat face of the valve seat body is formed into a spherical shape with a radius of curvature R satisfying $9\ \text{mm} < R < 11\ \text{mm}$.

According to this configuration, since the other of the engagement face of the third valve portion and the seat face of the valve seat body is formed into a tapered surface shape having a center angle $\alpha$ satisfying the above condition and one of the engagement face of the third valve portion and the seat face of the valve seat body is formed into a spherical shape with the radius of curvature R satisfying the above condition, the liquid refrigerant is discharged efficiently and transition to a desired capacity control can be made more rapidly.

In the above configuration, such a configuration may be employed that a pressure receiving area of the pressure sensitive body and a pressure receiving area of the third valve portion are formed into the same.

According to the configuration, since the control chamber pressure acting on the pressure sensitive body is cancelled in the third valve chamber, in the normal capacity control state, the valve body can carry out stable capacity control not being affected by the control chamber pressure.

In the above configuration, such a configuration may be employed that the third valve chamber is formed closer to the control chamber rather than the first valve chamber in the middle of the discharge-side path, the third valve portion is provided on a side opposite to the second valve portion. The first valve portion is put between the first valve portion and the second valve portion so as to penetrate from the first valve chamber to the third valve chamber. The valve body forms a part of the suction-side path so as to penetrate from the second valve portion to the third valve portion in the axial direction The suction-side path from the third valve chamber to the control chamber and the discharge-side path from the third valve chamber to the control chamber are formed as the same path. According to this configuration, the first valve chamber where the first valve portion is arranged, the second valve chamber where the second valve portion is arranged, and the third valve chamber where the third valve portion is arranged can be aligned easily along the longitudinal direction (reciprocating direction) of the valve body having the third valve portion, the first valve portion, and the second valve portion, which can achieve integration of the entire configuration, simplification of the structure and reduction of the size.

In the above configuration, such a configuration may be employed that the third valve portion is formed into a shape widened from a reduced diameter shape portion to the end from the first valve chamber toward the third valve chamber and has a ring-like engagement face on its outer circumferential edge, and the valve seat body is formed into a concave shape and has a ring-like seat face on the outer circumferential edge.

According to this configuration, while a path having the third valve chamber communicate with the first valve chamber can be sufficiently secured, the seat face on which the first valve portion is seated can be formed, and also, the third valve portion having an outer diameter larger than the outer diameter of the first valve portion can be formed easily. Also, by mounting the third valve portion to the valve body later, assembling can be made easily.

In the above configuration, such a configuration may be employed that a pressure receiving area of the third valve portion is set larger than a pressure receiving area of the first valve portion.

According to this configuration, when the first valve portion is opened and a discharge fluid (discharge pressure) flows from the discharge chamber into the third valve chamber and the control chamber, since the third valve portion receives the pressure in the direction to open the first valve portion, rapid rise of the control chamber pressure can be restrained, and gentle pressure change characteristics can be obtained. Therefore, when an existing capacity control valve has such a gentle pressure change characteristic, the capacity control valve of the present invention can be replaced by an existing capacity control valve without requiring any other particular change.

In the above configuration, such a configuration may be employed that an effective diameter $\phi b$ of the pressure sensitive body and a seal diameter $\phi r1$ of the third valve portion is formed so as to satisfy $0.8 < \phi r1/\phi b < 1.0$.

According to this configuration, at start, a differential pressure between the control chamber and the suction chamber effectively acts in a direction to open the third valve portion and the opening-valve amount of the third valve portion can be made the largest. Therefore, the liquid refrigerant accumulating in the control chamber can be discharged more efficiently.

Advantageous Effect of the Invention

According to the capacity control valve configured as above, since the liquid refrigerant accumulating in the control chamber can be rapidly discharged particularly immediately after start of the variable capacity compressor, the desired capacity control can be carried out rapidly and securely, and also, a capacity control valve which can achieve stable capacity control and reduction in entire size and costs can be obtained.

EXPLANATIONS OF LETTERS AND NUMERALS

Figure 1:
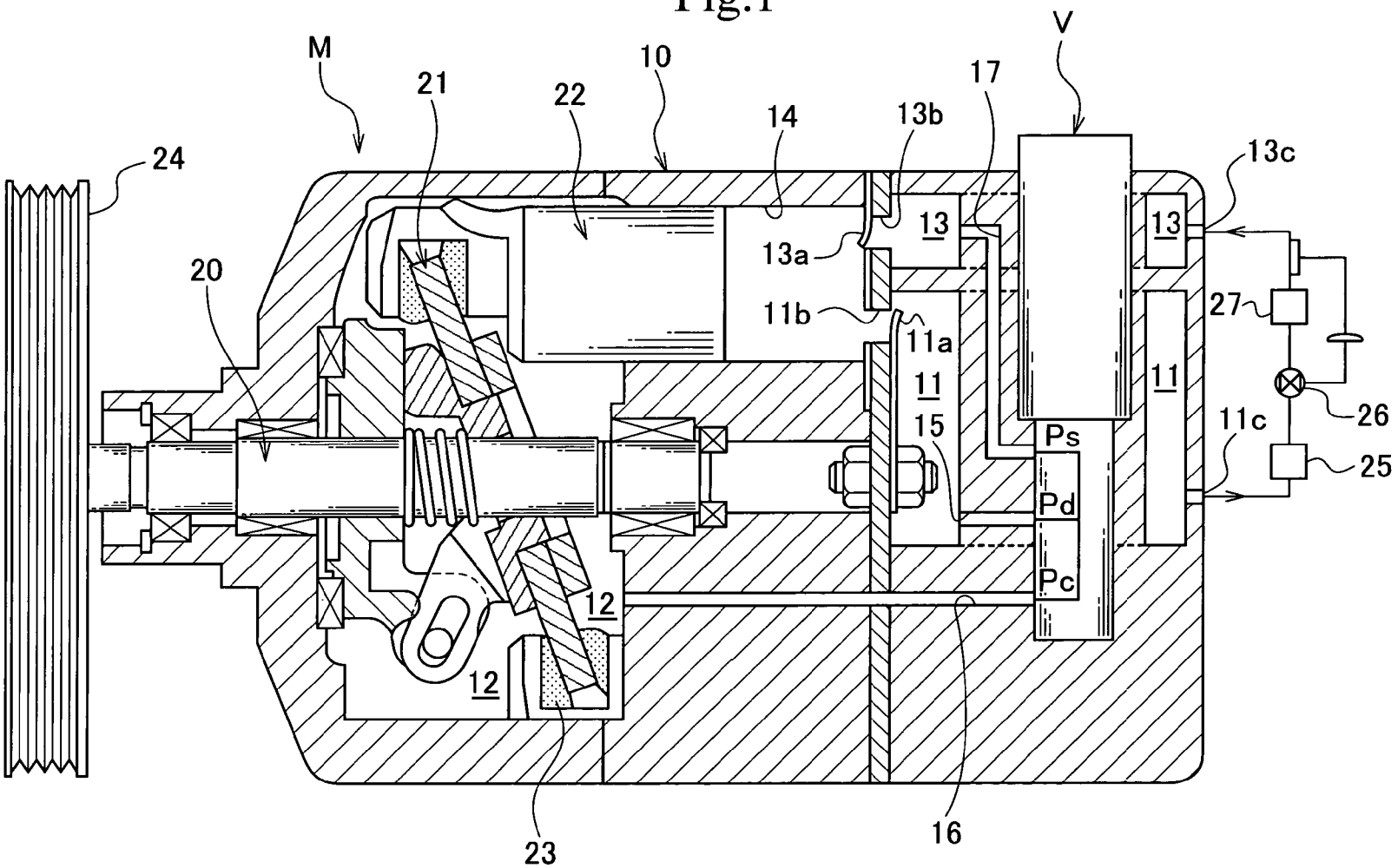
FIG. 1 is a schematic block diagram illustrating a swash plate type variable capacity compressor provided with a capacity control valve according to the present invention.

M: Swash plate type variable capacity compressor
V: Capacity control valve
10: Casing
11: Discharge chamber
12: Control chamber
13: Suction chamber
14: Cylinder
15: Communication path (discharge-side path)
16: Communication path (discharge-side path, suction-side path)
17: Communication path (suction-side path)
20: Rotating shaft
21: Swash plate
22: Piston
23: Connecting member
24: Driven pulley
25: Condenser
26: Expansion valve
27: Evaporator
30: Body
31, 32: Communication path (discharge-side path)
33: Communication path (discharge-side path, suction-side path)
34: Communication path (suction-side path)
35: First valve chamber
35*a*: Seat face
36: Second valve chamber
36*a*: Seat face
37: Guide path
38: Third valve chamber
39: Closing member
40: Valve body
41: First valve portion
42: Second valve portion
43: Third valve portion
43*a*: Ring-like engagement face
44: Communication path (suction-side path)
50: Pressure sensitive body
51: Bellows
52: Coil spring
53: Valve seat body
53*a*: Ring-like seat face
60: Solenoid
61: Solenoid body
62: Casing
63: Sleeve
64: Fixed iron core
65: Driving rod
66: Movable iron core
67: Coil spring
68: Coil for excitation
Pd: Discharge pressure
Pc: Control chamber pressure
Ps: Suction pressure
R: Radius of curvature
$\alpha$: Center angle
Ab: Pressure receiving area of pressure sensitive body
Ar1: Pressure receiving area of third valve portion
As: Pressure receiving area of first valve portion
Ar2: Pressure receiving area of second valve portion
$\phi$b: Effective diameter of pressure sensitive body
$\phi$r1: Seal diameter of third valve portion

DETAILED DESCRIPTION OF THE INVENTION

A preferred embodiment of the present invention will be described below with reference to the attached drawings.

A swash plate type variable capacity compressor M includes, as shown in FIG. 1, a discharge chamber 11, a control chamber (also referred to as a crank chamber) 12, a suction chamber 13, a plurality of cylinders 14, a port 11*b* having the cylinders 14 communicate with the discharge chamber 11 and opened/closed by a discharge valve 11*a*, a port 13*b* having the cylinders 14 communicate with the suction chamber 13 and opened/closed by a suction valve 13*a*, a discharge port 11*c* and a suction port 13*c* connected to an external cooling circuit, a communication path 15 as a discharge-side path for having the discharge chamber 11 communicate with the control chamber 12, a communication path 16 serving as the above discharge-side path and serving as a suction-side path for having the control chamber 12 communicate with the suction chamber 13, a casing 10 defining a communication path 17 as a suction-side path or the like, a rotating shaft 20 rotatably provided and projecting from inside the control chamber (crank chamber) 12 to the outside, a swash plate 21 integrally rotating with the rotating shaft 20 and connected to the rotating shaft 20 with a variable inclination angle, a plurality of pistons 22 fitted into each of the cylinders 14 so as to be capable of reciprocating, a plurality of connecting members 23 connecting the swash plate 21 to each of the pistons 22, a driven pulley 24 mounted at the rotating shaft 20, a capacity control valve V of the present invention incorporated in the casing 10 and the like.

Also, in this swash plate type variable capacity compressor M, a cooling circuit is connected to the discharge port 11*c* and the suction port 13*c*, and to this cooling circuit, a condenser 25, an expansion valve 26, and an evaporator 27 are arranged sequentially.

Figure 2:
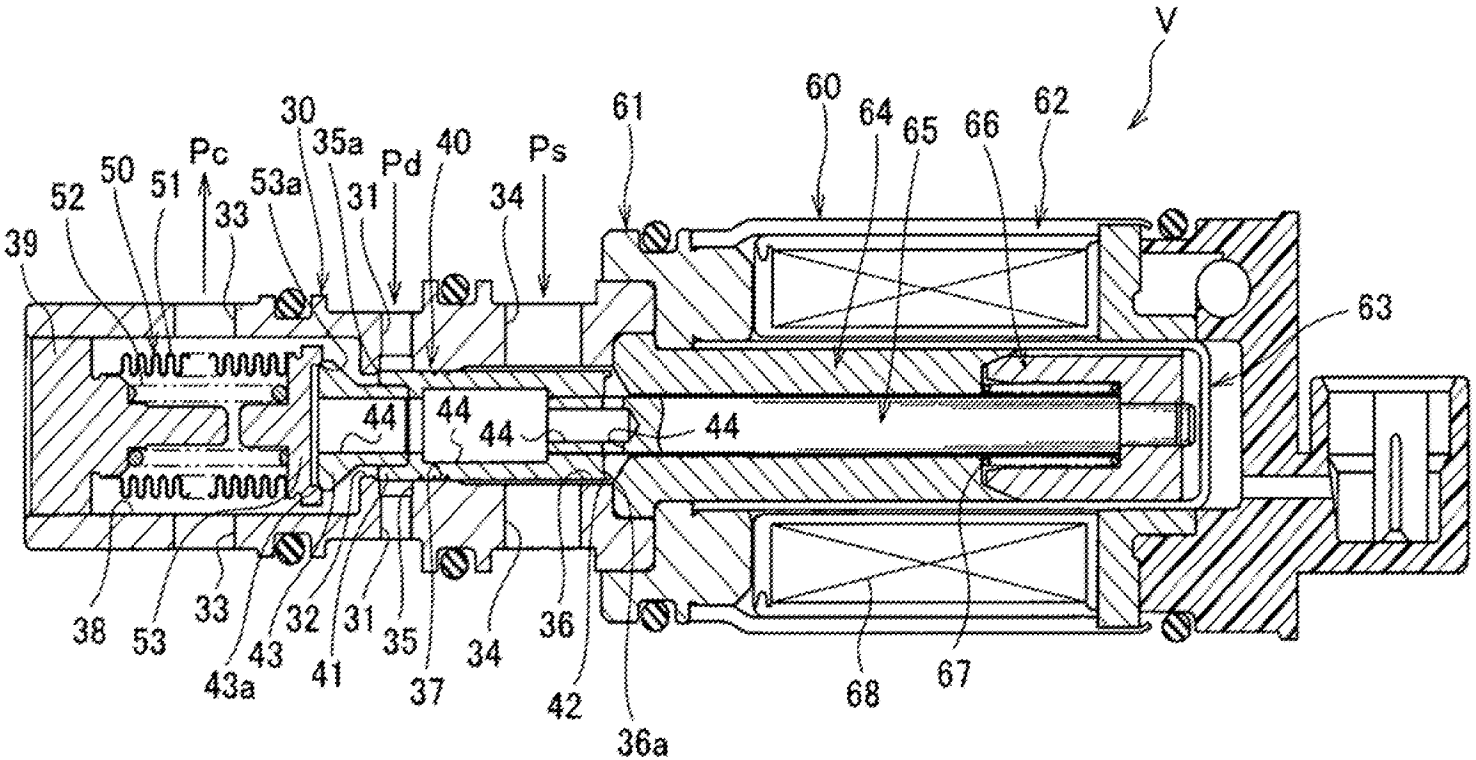
FIG. 2 is a sectional view illustrating an embodiment of the capacity control valve according to the present invention.

The capacity control valve V includes, as shown in FIG. 2, a body 30 formed from a metal material or a resin material, a valve body 40 arranged in the body 30 so as to be capable of reciprocating, a pressure sensitive body 50 urging the valve body 40 in one direction, a solenoid 60 connected to the body 30 and applying an electromagnetic driving force to the valve body 40, and the like.

The body 30 is provided with, as shown in FIGS. 2 to 5, communication paths 31, 32, 33 functioning as discharge-side paths, communication paths 33, 34 functioning as suction-side paths together with a communication path 44 of the valve body 40 as described later, a first valve chamber 35 formed in the middle of the discharge-side path, a second valve chamber 36 formed in the middle of the suction-side path, a guide path 37 for guiding the valve body 40, a third valve chamber 38 formed close to the control chamber 12 of the discharge-side path and the suction-side path and the like. Also, the body 30 has a closing member 39 mounted thereon by screwing which defines the third valve chamber 38 and constitutes a part of the body 30.

That is, the communication path 33 and the third valve chamber 38 are formed so as to function as a part of the discharge-side path and the suction-side path, and the communication path 32 defines a valve hole having the first valve chamber 35 and the third valve chamber 38 communicate with each other and through which the valve body 40 is inserted (through which the valve body 40 is inserted while a gap through which a fluid flows is ensured). Besides, the communication paths 31, 33, 34 are formed in plural (four with an interval of 90 degrees, for example), arranged radially in the circumferential direction, respectively.

In the first valve chamber 35, on an edge portion of the communication path (valve hole) 32, a seat face 35*a* on which a first valve portion 41 of the valve body 40 described later is seated is formed, and in the second valve chamber 36, at an end of a fixed iron core 64 described later, a seat face 36*a* on which a second valve portion 42 of the valve body 40 described later is seated, is formed.

Here, since the suction-side path from the control chamber 12 to the third valve chamber 38 and the discharge-side path from the third valve chamber 38 to the control chamber 12 are formed as the same communication path 33, the first valve chamber 35, the second valve chamber 36, and the third valve chamber 38 can be easily arranged along the longitudinal direction (reciprocating direction) of the valve body 40, by which integration of the entirety, simplification of the structure and reduction of the size can be achieved.

The valve body 40 is, as shown in FIGS. 2 to 5, formed into a substantially cylindrical shape and provided with the first valve portion 41 on one side, the second valve portion 42 on the other end. A third valve portion 43 is connected to the side of the valve body 40 opposite to the second valve portion 42, with the first valve portion 41 between the second valve portion 42 and the third valve portion 43. A communication path 44 is provided in the valve body 40 penetrating in the axial direction from the second valve portion 42 to the third valve portion 43 and functioning as the suction-side path and the like.

The third valve portion 43 is formed into a shape widened from a reduced diameter shape portion to the end from the first valve chamber 35 toward the third valve chamber 38, penetrating through the communication path (valve hole) 32, and is provided with a ring-like engagement face 43*a* opposed to a valve seat body 53 described later at its outer circumferential edge.

Figure 6:
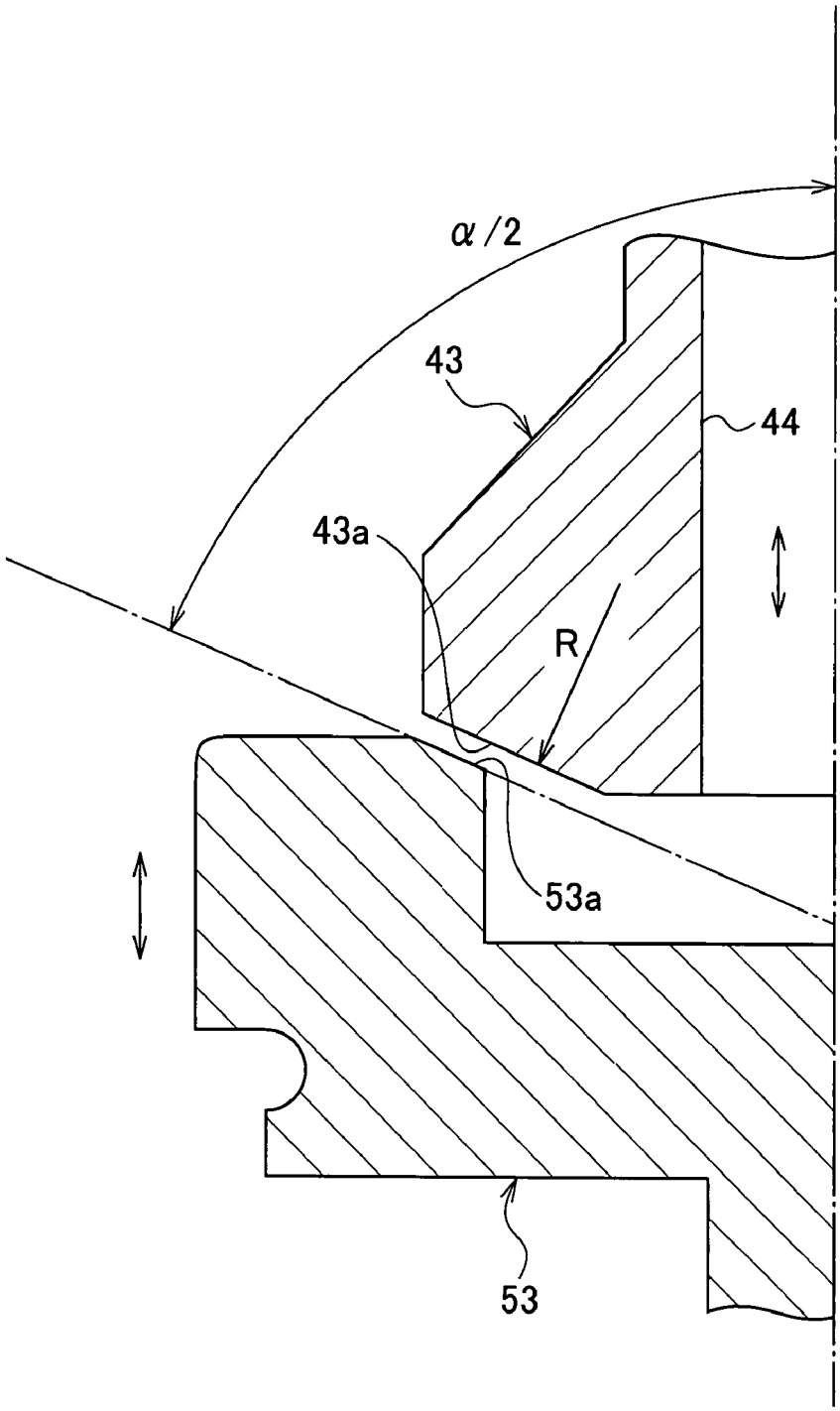
FIG. 6 is a partially enlarged sectional view showing a third valve portion and a valve seat body in the capacity control valve in an enlarged manner.

Here, the engagement face 43*a* of the third valve portion 43 is, as shown in FIG. 6, formed into an outward convex shape and into a spherical (i.e. rounded) shape forming a radius of curvature R, and with a value of the radius of curvature R satisfying 9 mm<R<11 mm.

The pressure sensitive body 50 is, as shown in FIGS. 2 to 5, provided with a bellows 51, a coil spring 52 arranged in the compressed manner within the bellows 51, a valve seat body 53 and the like. The bellows 51 is fixed at its one end to the closing member 39 and holds the valve seat body 53 at its other end (free end).

The valve seat body 53 is provided with a ring-like seat face 53*a* at its outer circumferential edge for engagement and disengagement with the engagement face 43*a* of the third valve portion 43 in an opposed manner.

Here, the seat face 53*a* of the valve seat body 53 is, as shown in FIG. 6, formed into an outward (direction opposing the third valve portion 43) concave shape and into a tapered surface shape forming a center angle $\alpha$, and with a value of the center angle $\alpha$ satisfying $120° < \alpha < 160°$.

That is, the pressure sensitive body 50 is arranged within the third valve chamber 38 and is operated to apply an urging force in a direction to open the first valve portion 41 by its extension (expansion) and to weaken the urging force applied on the first valve portion 41 by contraction with pressure increase of the surroundings (inside the third valve chamber 38 and the communication path 44 of the valve body 40).

As mentioned above, in the relation between the third valve portion 43 opening and closing the suction-side path (communication path 44) and the valve seat body 53, by having a relation that the radius of curvature R of the engagement face 43*a* forming the spherical shape is set at 9 mm<R<11 mm and the center angle $\alpha$ of the seat face 53*a* forming the tapered surface shape is set at $120° < \alpha < 160°$, that is, $\alpha = 120°$ corresponds to R=9 mm and $\alpha = 160°$ corresponds to R=11, a required channel area for efficient discharge of a liquid refrigerant (control chamber pressure Pc) immediately after start can be ensured while the size of the entirety is reduced. The effective diameter $\phi b$ (specifying the effective pressure receiving area) of the bellows 51 at this time is approximately $\phi 8$ mm.

Figure 7:
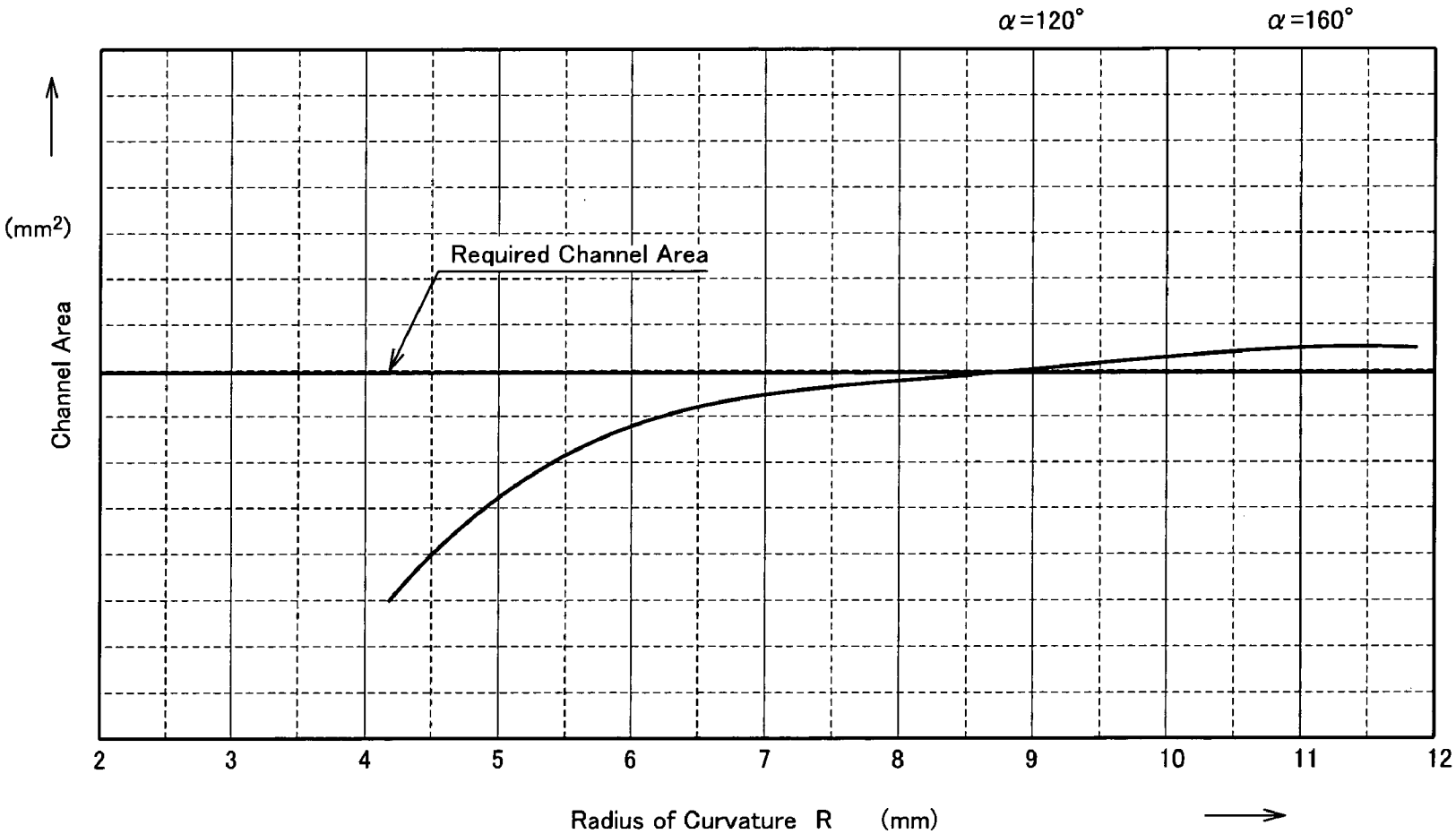
FIG. 7 is a diagram illustrating a relation between a radius of curvature R formed into a spherical shape and a channel area in a relation between an engagement face of the third valve portion and a seat face of the valve seat body in the capacity control valve.

That is, as shown in FIG. 7, in a region where the radius of curvature R of the engagement face 43*a* exceeds 9 mm (at this time, the center angle $\alpha$ of the seat face 53*a* is 120°), a required channel area for rapid discharge of the liquid refrigerant from the control chamber 12 can be ensured, while in a region where the radius of curvature R of the engagement face 43*a* exceeds 11 mm (at this time, the center angle $\alpha$ of the seat face 53*a* is 160°), since the channel area is not increased, by setting the radius of curvature R smaller than 11 mm, increase in size of the third valve portion 43 and the valve seat body 53 more than necessary is prevented, by which the size reduction of the entirety can be achieved.

Also, since the third valve portion 43 and the valve seat body 53 are engaged in the manner that the convex fits in the concave when the valve is closed, an aligning action can be obtained, by which the communication paths (suction-side paths) 44, 33 can be surely closed (sealed).

The solenoid 60 is, as shown in FIG. 2, a solenoid body 61 connected to the body 30, a casing 62 enclosing the entirety, a sleeve 63 whose one end is closed, a cylindrical fixed iron core 64 arranged inside the solenoid body 61 and the sleeve 63, a driving rod 65 capable of reciprocating in the fixed iron core 64 and having its tip end connected to the valve body 40 so as to form the communication path 44, a movable iron core 66 fixed to the other end of the driving rod 65, a coil spring 67 urging the first valve portion 41 in a direction to open the valve, a coil 68 for excitation wound outside the sleeve 63 through a bobbin and the like.

Figure 3:
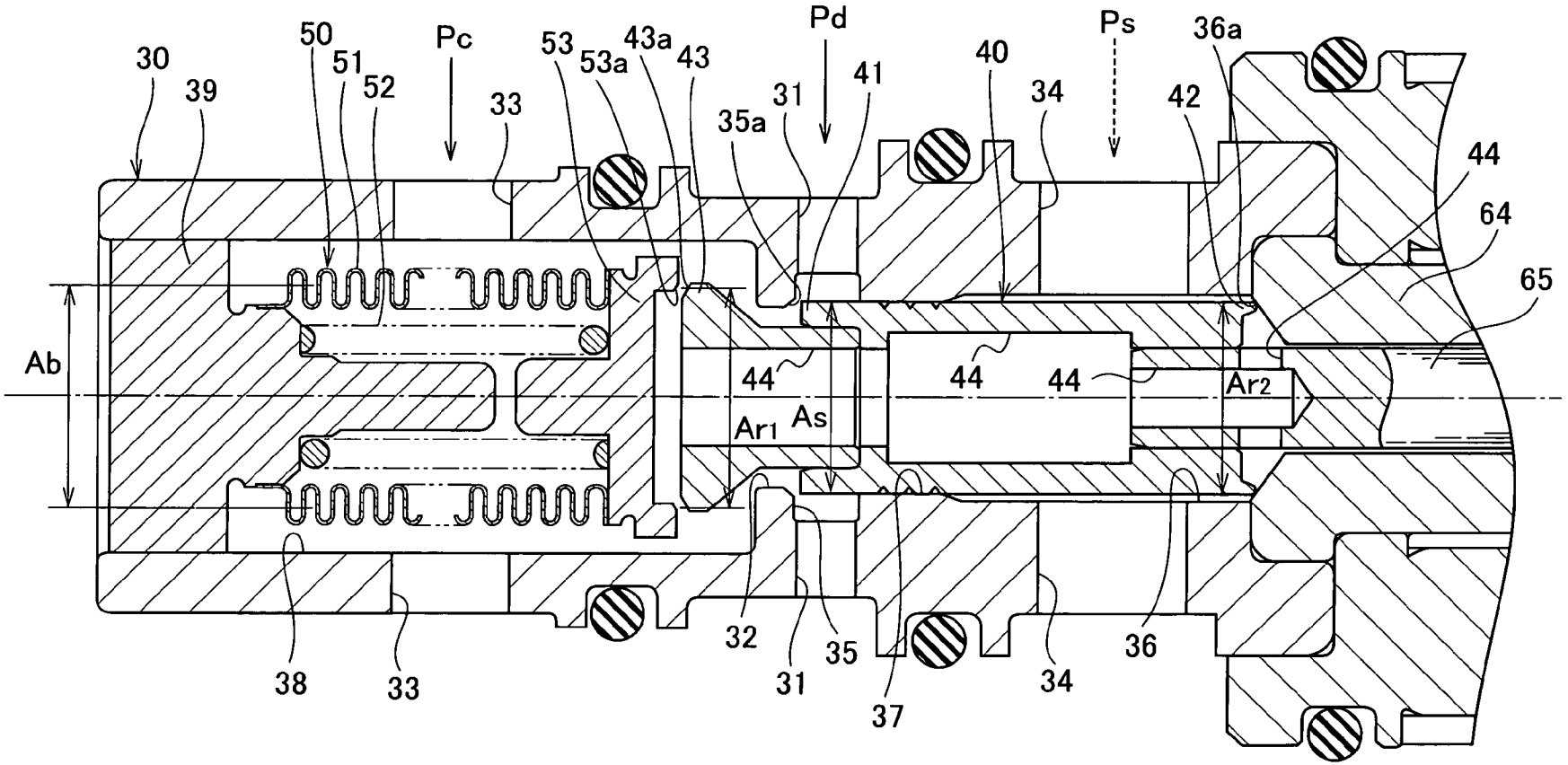
FIG. 3 is a partially enlarged sectional view showing a part of the capacity control valve in an enlarged manner.

In the above configuration, when the coil 68 is not energized, the valve body 40 is moved to the right side in FIG. 3 by the urging force of the pressure sensitive body 50 and the coil spring 67, the first valve portion 41 is separated from the seat face 35*a* to open the communication paths (discharge-side paths) 31, 32 and at the same time, the second valve portion 42 is seated on the seat face 36*a* to close the communication paths (suction-side paths) 34, 44. At this time, when the control chamber pressure Pc rises at a predetermined level or more, as shown in FIG. 3, the pressure sensitive body 50 is contracted to retreat and remove the valve seat body 53 from the third valve portion 43 (the suction-side path is opened in the third valve chamber 38).

Figure 4:
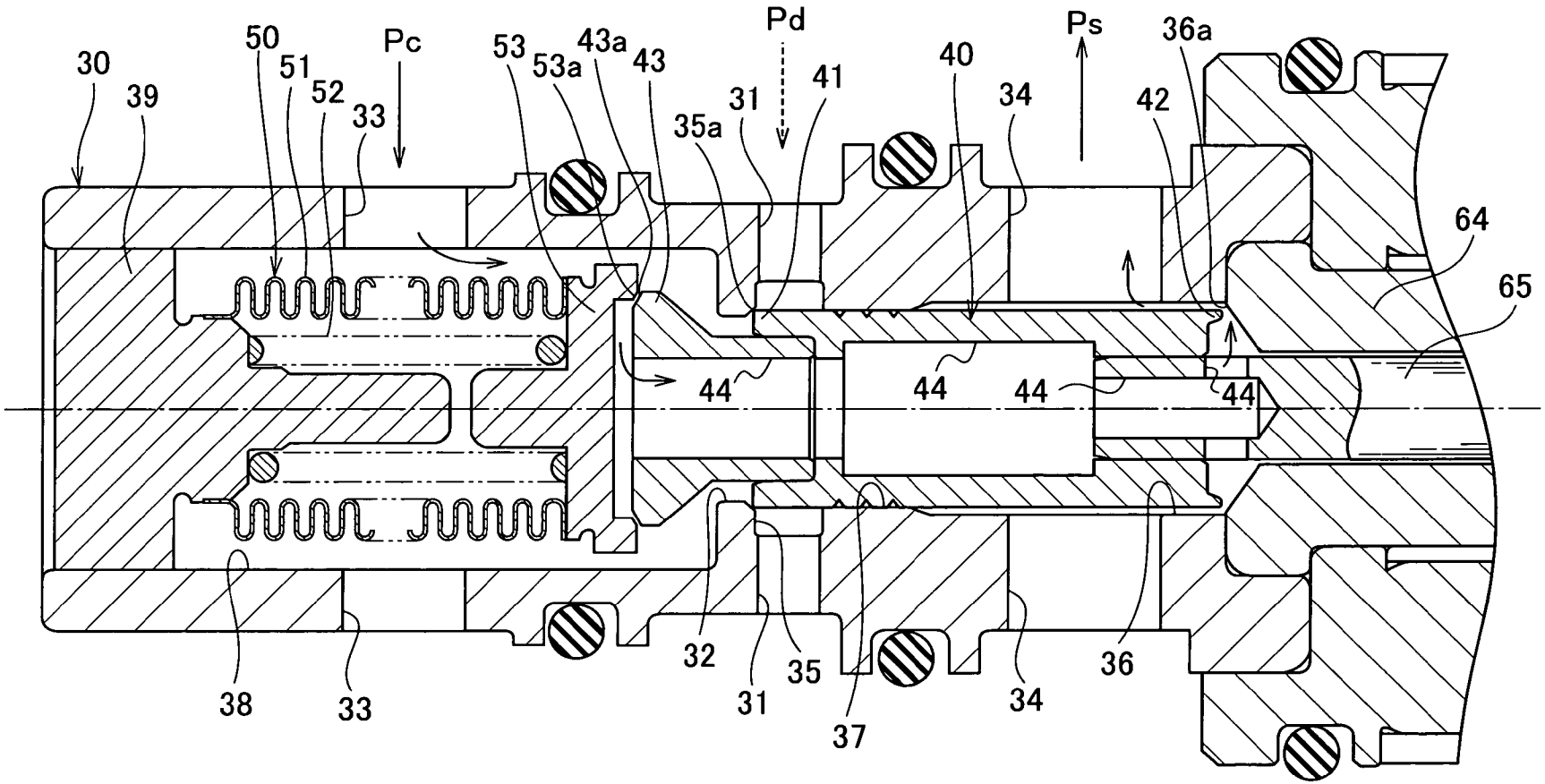
FIG. 4 is a partially enlarged sectional view showing a part of the capacity control valve in an enlarged manner.
Figure 5:
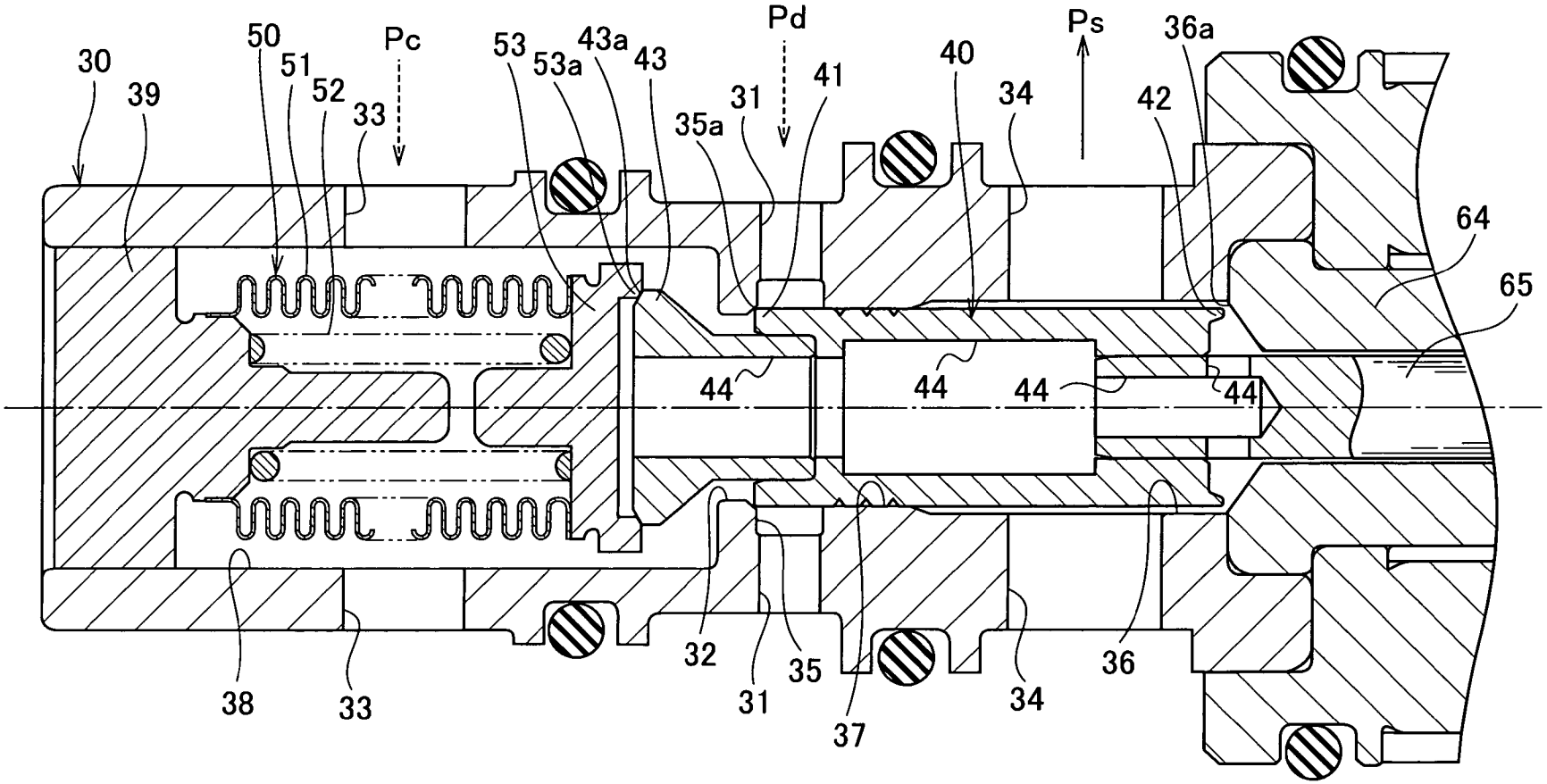
FIG. 5 is a partially enlarged sectional view showing a part of the capacity control valve in an enlarged manner.

On the other hand, when the coil 68 is energized to a predetermined electric-current value (I) or more, by the electromagnetic driving force (urging force) of the solenoid 60 acting in a direction opposite to the urging force of the pressure sensitive body 50 and the coil spring 67, the valve body 40 is moved to the left side in FIG. 5, the first valve portion 41 is seated on the seat face 35*a* to close the communication paths (discharge-side paths) 31, 32 and at the same time, the second valve portion 42 is separated from the seat face 36*a* to open the communication paths (suction-side paths) 34, 44. Immediately after this start, when the control chamber pressure Pc is at a predetermined level or more, as shown in FIG. 4, for the period from when the valve seat body 53 is separated from the third valve portion 43 to open the suction-side path till when the third valve portion 43 is seated on the valve seat body 53, the liquid refrigerant or the like accumulating in the control chamber 12 is discharged into the suction chamber 13 via the communication paths (suction-side paths) 44, 34.

In the above configuration, as shown in FIG. 3, when the pressure receiving area by the effective diameter ϕb of (the bellows 51 of) the pressure sensitive body 50 is Ab, the pressure receiving area by the seal diameter ϕr1 of the third valve portion 43 is Ar1, the pressure receiving area by the seal diameter of the first valve portion 41 is As, the pressure receiving area by the seal diameter of the second valve portion 42 is Ar2, the urging force of the pressure sensitive body 50 is Fb, the urging force of the coil spring 67 is Fs, the urging force by the electromagnetic driving force of the solenoid 60 is Fsol, the discharge pressure of the discharge chamber 11 is Pd, the suction pressure of the suction chamber 13 is Ps, and the control chamber pressure of the control chamber (crank chamber) 12 is Pc, a relation of balances of forces acting on the valve 40 is as follows:

$$Pc\cdot(Ab-Ar1)+Pc\cdot(Ar1-As)+Ps\cdot Ar1+Ps\cdot(Ar2-Ar1)+Pd\cdot(As-Ar2)=Fb+Fs-Fsol$$

In the above configuration, the pressure receiving area Ab of the pressure sensitive body 50 and the pressure receiving area Ar1 of the third valve portion 43 are formed into the same, the pressure receiving area As of the first valve portion 41 and the pressure receiving area Ar2 of the second valve portion 42 are formed into the same, and the pressure receiving area Ar1 of the third valve portion 43 is formed larger than the pressure receiving area As of the first valve portion 41.

That is, by setting the pressure receiving area Ab=the pressure receiving area Ar1, the control chamber pressure Pc acting on the pressure sensitive body 50 in the third valve chamber 38 is offset and its influence can be prevented, operation of the valve body 40 not affected by the control chamber pressure Pc is enabled, and stable capacity control is realized.

Also, by setting the pressure receiving area As=the pressure receiving area Ar2, the discharge pressure Pd acting on the valve body 40 is offset and its influence can be prevented, operation of the valve body 40 not affected by the discharge pressure Pd is enabled, and stable capacity control is realized.

Figure 8:
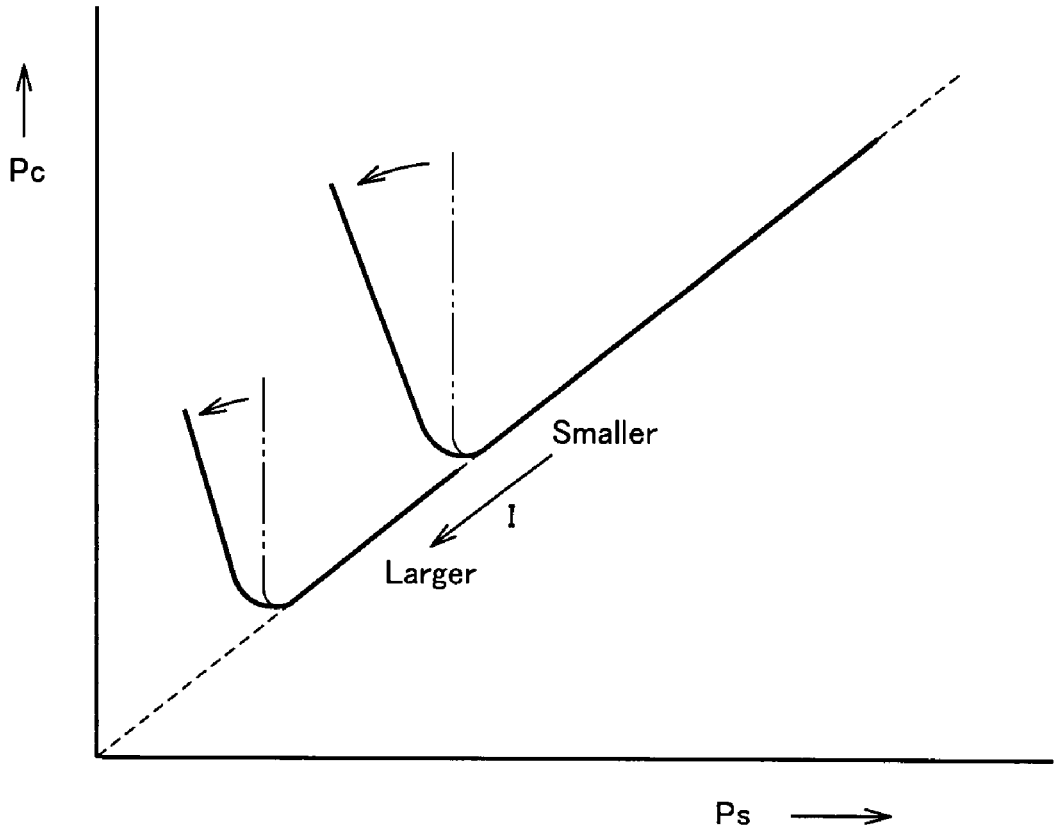
FIG. 8 is a diagram illustrating a pressure characteristic when a pressure receiving area of the third valve portion is made larger than a pressure receiving area of the first valve portion in the capacity control valve.

Moreover, by setting the pressure receiving area Ar1>the pressure receiving area As, when the first valve portion 41 is opened and a discharge fluid (discharge pressure Pd) flows from the discharge chamber 11 into the third valve chamber 38 and the control chamber 12, since the third valve portion 43 receives the discharge pressure Pd in a direction to close the first valve portion 41 by an amount corresponding to a difference of the pressure receiving areas (Ar1−As), rapid rise of the control chamber pressure Pc can be restrained as a characteristic shown by a two-dotted chain lain to a characteristic shown by a solid line in FIG. 8, and a gentle pressure change characteristic can be obtained. Therefore, when an existing capacity control valve has this gentle pressure change characteristic, the capacity control valve V of the present invention can be replaced by the existing capacity control valve without changing control software and other configurations.

Next, action will be described when the swash plate type variable capacity compressor M provided with the capacity control valve V is applied to an air-conditioning system for an automobile.

First, when the rotating shaft 20 is rotated by the rotating driving force of an engine through a transmission belt (not shown) and a driven pulley 24, the swash plate 21 is rotated integrally with the rotating shaft 20. When the swash plate 21 is rotated, the piston 22 reciprocates within the cylinder 14 by a stroke according to the inclination angle of the swash plate 21, and a refrigerant gas sucked into the cylinder 14 from the suction chamber 13 is compressed by the piston 22 and discharged into the discharge chamber 11. The discharged refrigerant gas is supplied from the condenser 25 to the evaporator 27 through the expansion valve 26 and returned to the suction chamber 13 through a refrigerating cycle.

Here, the discharge amount of the refrigerant gas is determined by the stroke of the piston 22, and the stroke of the piston 22 is determined by the inclination angle of the swash plate 21 controlled by the pressure (control chamber pressure Pc) in the control chamber 12.

First, the solenoid 60 is turned off, and when the variable capacity compressor is left in a stopped state for a long time with the second valve portion 42 closing the communication paths (suction-side paths) 34, 44, the liquid refrigerant accumulates in the control chamber 12 and the control chamber pressure Pc is raised. And as shown in FIG. 3, the control chamber pressure Pc contracts the pressure sensitive body 50 and separates the third valve portion 43 from the valve seat body 53 and opens the valve.

In this state, when the solenoid 60 is turned on and the valve body 40 is started, the first valve portion 41 is moved in the valve-closing direction and the second valve portion 42 is moved in the valve-opening direction at the same time. While the second valve portion 42 is opened and opens the communication paths (suction-side paths) 44, 34, as shown in FIG. 4, the liquid refrigerant in the control chamber 12 is discharged into the suction chamber 13 from the communication paths (suction-side paths) 33, 44, 34. And when the control chamber pressure Pc drops below the predetermined level, the pressure sensitive body 50 is elastically returned and extended and as shown in FIG. 5, the valve seat body 53 is engaged with the third valve portion 43 and closed so as to close the communication paths (suction-side paths) 33, 44, 34.

In this discharge process, since the engagement face 43*a* of the third valve portion 43 is formed into a spherical shape forming the radius of curvature R (9 mm<R<11 mm) and the seat face 53*a* of the valve seat body 53 is formed into a tapered surface shape forming a center angle α (120°<α<160°), the liquid refrigerant is efficiently discharged and rapid transition to a desired capacity control can be realized.

In the driving state with the minimum discharge amount, the solenoid 60 (coil 68) is not energized, the movable iron core 66 and the driving rod 65 are retreated by the urging force of the coil springs 52, 67 to be stopped at a rest position, and the valve body 40 is moved to the position where the first valve portion 41 is separated from the seat face 35*a* and opens the communication paths (discharge-side paths) 31, 32, the second valve portion 42 is seated on the seat face 36*a* and closes the communication paths (suction-side paths) 34, 44. By this, the discharge fluid (discharge pressure Pd) is supplied into the control chamber 12 through the communication paths (discharge-side paths) 31, 32, 33. And the inclination angle of the swash plate 21 is controlled to be the smallest to minimize the stroke of the piston 22. As a result, the discharge amount of the refrigerant gas becomes the minimum.

On the other hand, in the operating state with the maximum discharge amount, the solenoid 60 (coil 68) is energized at a predetermined electric current value (I), the movable iron core 66 and the driving rod 65 resist the urging force of the pressure sensitive body 50 and the coil spring 67, and the valve body 40 is moved to the position where the first valve portion 41 is seated on the seat face 35*a* and closes the communication paths (discharge-side paths) 31, 32, and the second valve portion 42 is separated from the seat face 36*a* and opens the communication paths (suction-side paths) 34, 44.

Also, when the fluid accumulates in the control chamber 12 and the control chamber pressure Pc is raised above the predetermined level, the pressure sensitive body 50 is contracted by receiving the pressure and the valve seat body 53 is separated from the third valve portion 43 and opens the communication paths (suction-side paths) 33, 44, and thus, the fluid (refrigerant gas, blow-by gas and the like) accumulating in the control chamber 12 is discharged into the suction chamber 13 through the communication paths (suction-side paths) 33, 44, 34. By this, the inclination angle of the swash plate 21 is controlled to become the largest to maximize the stroke of the piston 22. As a result, the discharge amount of the refrigerant gas becomes the maximum.

In the operating state with the discharge amount in an intermediate region between the minimum to the maximum, the intensity of the energization to the solenoid 60 (coil 67) is controlled appropriately and the electromagnetic force (urging force) is varied. That is, the position of the valve body 40 is adjusted appropriately by the electromagnetic force and the valve opening amount of the first valve portion 41 and the valve opening amount of the second valve portion 42 are controlled so as to have a desired discharge amount.

In the above embodiment, the third valve chamber 38 in which the pressure sensitive body 50 (valve seat body 53) and the third valve portion 43 are arranged is provided in the middle of the communication path functioning as the discharge-side path and the suction-side path, but not limited to this, it may be provided in the middle of the suction-side path formed as another path.

In the above embodiment, such a case is shown that the pressure receiving area Ab of the pressure sensitive body 50 is formed into the same as the pressure receiving area Ar1 of the third valve portion 43, but not limited to this, either one of the engagement face 43*a* of the third valve portion 43 and the seat face 53*a* of the valve seat body 54 may be formed into a spherical shape, while the other of the engagement face 43*a* of the third valve portion 43 and the seat face 53*a* of the valve seat body 54 may be formed into a tapered surface shape forming the center angle α satisfying 120°<α<160°, and moreover, the relation between the effective diameter φb of the pressure sensitive body 50 and the seal diameter φr1 of the third valve portion 43 may be formed so as to satisfy:

$$0.8<\phi r1/\phi b<1.0.$$

Figure 9:
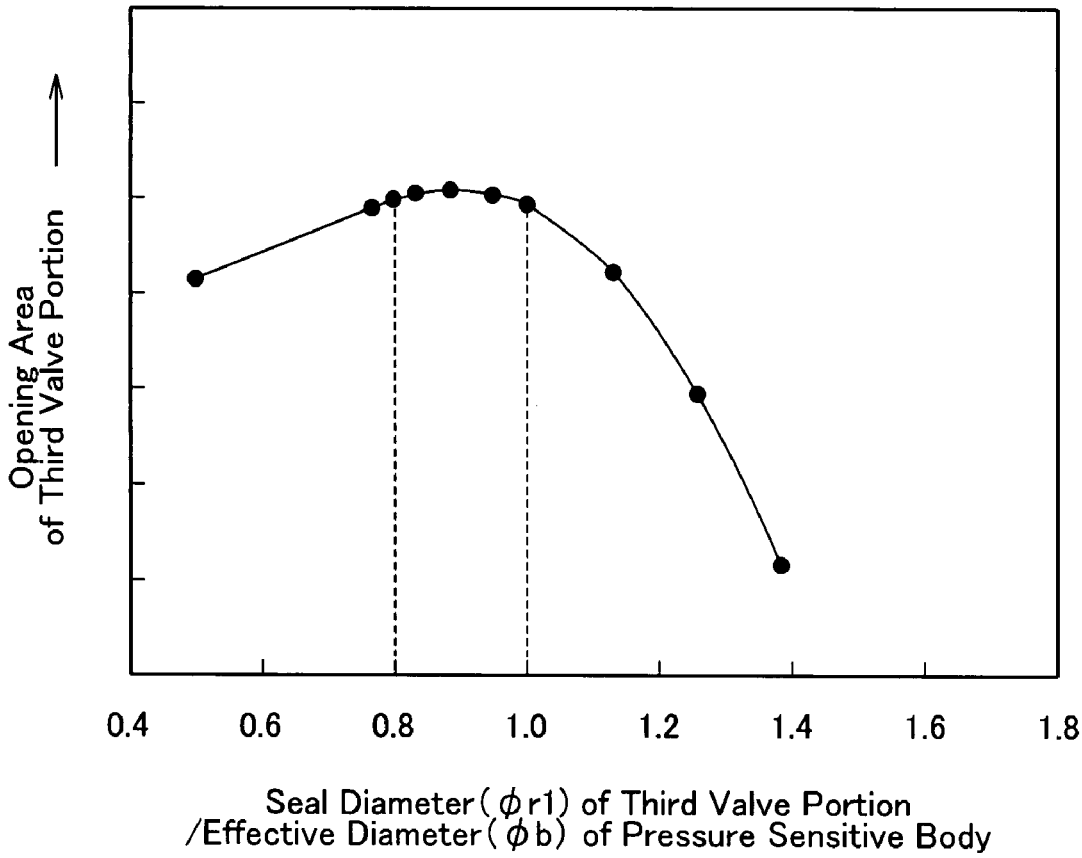
FIG. 9 is a graph illustrating a characteristic regarding an opening area of the third valve portion in the capacity control valve.

According to this, by making the seal diameter φr1 of the third valve portion 43 slightly smaller than the effective diameter φb of the pressure sensitive body 50, a differential pressure (Pc−Ps) between the control chamber 12 and the suction chamber 13 effectively acts in a direction to open the third valve portion 43 at start, and as shown in FIG. 9, the valve opening amount (opening area) of the third valve portion 43 can be made the largest. Therefore, the liquid refrigerant accumulating in the control chamber 12 can be discharged more efficiently.

In the above embodiment, such a case is shown that the engagement face 43*a* of the third valve portion 43 is formed into a spherical shape with the radius of curvature R satisfying 9 mm<R<11 mm, and the seat face 53*a* of the valve seat body 53 is formed into a tapered surface shape forming the center angle α satisfying 120°<α<160°, but not limited to this, a configuration may be employed that on the contrary, the engagement face 43*a* of the third valve portion 43 is formed into a tapered surface shape forming the center angle α satisfying 120°<α<160° and the seat face 53*a* of the valve seat body 53 is formed into a spherical shape with the radius of curvature R satisfying 9 mm<R<11 mm, or one of the engagement face 43*a* of the third valve portion 43 and the seat face 53*a* of the valve seat body 53 may be formed into a spherical shape and the other of the engagement face 43*a* of the third valve portion 43 and the seat face 53*a* of the valve seat body 53 may be formed into a tapered surface shape forming the center angle α satisfying 120°<α<160°.

Also, the relation between the center angle α and the radius of curvature R is not limited to the above, but each combination in a range of 9 mm<R<11 mm and 120°<α160° exerts the same effect.

INDUSTRIAL APPLICABILITY

As described above, in the capacity control valve of the present invention, particularly immediately after start of the variable capacity compressor, the liquid refrigerant accumulating in the control chamber can be rapidly discharged so as to carry out a desired capacity control rapidly and surely, and also, the size, costs and the like of the entirety can be reduced. Therefore, it is needless to say that the capacity control valve of the present invention can be applied to a variable capacity compressor used in an air-conditioning system such as an automobile but also useful as a capacity control valve for capacity control in other machines variably controlling the capacity of a fluid.

The invention claimed is:

1. A capacity control valve for controlling a discharge amount of a variable capacity compressor that includes a discharge chamber for discharging a fluid, a suction chamber for sucking the fluid and a control chamber communicating with the discharge chamber and the suction chamber, said capacity control valve comprising:

a discharge-side path for putting the discharge chamber in communication with the control chamber;

a first valve chamber formed in said discharge-side path;

a suction-side path for putting the suction chamber in communication with the control chamber;

a second valve chamber formed in said suction-side path;

a valve body integrally having a first valve portion for opening/closing said discharge-side path in said first valve chamber and a second valve portion for opening/closing said suction-side path in said second valve chamber, said first and second valve portions carrying out opening/closing operation opposite to each other by reciprocating motion;

a third valve chamber formed closer to a side of the capacity control valve to be connected to the control chamber than said second valve chamber;

a pressure sensitive body arranged in said third valve chamber, said pressure sensitive body applying an urging force in a direction to open said first valve portion by expansion of the pressure sensitive body, and contracting with increase in pressure of a surroundings of the pressure sensitive body;

a valve seat body provided at a free end in an expansion/contraction direction of said pressure sensitive body and having a seat face that is ring-like;

a third valve portion moving integrally with said valve body in said third valve chamber and having an engagement face that is ring-like, the engagement face opening/closing said suction-side path by engagement and disengagement with the seat face of said valve seat body; and a solenoid applying an electromagnetic driving force in a direction to close said first valve portion with respect to said valve body, wherein one of the engagement face of said third valve portion and the seat face of said valve seat body is formed into a rounded shape; and wherein the other of the engagement face of said third valve portion and the seat face of said valve seat body is formed into a tapered surface shape having a center angle $\alpha$ with respect to a direction of movement of the third valve portion, the center angle $\alpha$ satisfying $120° < \alpha < 160°$.

2. The capacity control valve according to claim 1, wherein said one of the engagement face of said third valve portion and the seat face of said valve seat body is formed into the rounded shape with a radius of curvature R satisfying 9 mm<R<11 mm.

3. The capacity control valve according to claim 1, wherein a pressure receiving area of said pressure sensitive body and a pressure receiving area of said third valve portion are formed equal in size.

4. The capacity control valve according to claim 1, wherein said one of the engagement face of said third valve portion and the seat face of said valve seat body is formed into the rounded shape with a radius of curvature R satisfying 9 mm<R<11 mm; and a pressure receiving area of said pressure sensitive body and a pressure receiving area of said third valve portion are formed equal in size.

5. The capacity control valve according to claim 1, wherein said third valve chamber is formed closer to the side of the capacity control valve to be connected to the control chamber than said first valve chamber;

said third valve portion is provided on a side of said first valve portion that is opposite to said second valve portion, and said first valve portion is disposed between said second valve portion and said third valve portion so as to extend from said first valve chamber to said third valve chamber;

said valve body extends from said second valve portion to said third valve portion in an axial direction and forms one portion of said suction-side path; and a segment of said suction-side path that extends from said third valve chamber to the side of the capacity control valve to be connected to the control chamber and a segment of said discharge-side path that extends from said third valve chamber to the side of the capacity control valve to be connected to the control chamber are formed as a common path.

6. The capacity control valve according to claim 1, wherein said one of the engagement face of said third valve portion and the seat face of said valve seat body is formed into the rounded shape with a radius of curvature R satisfying 9 mm<R<11 mm;

said third valve chamber is formed closer to the side of the capacity control valve to be connected to the control chamber than said first valve chamber;

said third valve portion is provided on a side of said first valve portion that is opposite to said second valve portion, and said first valve portion is disposed between said second valve portion and said third valve portion so as to extend from said first valve chamber to said third valve chamber;

said valve body extends from said second valve portion to said third valve portion in an axial direction and forms one portion of said suction-side path; and a segment of said suction-side path that extends from said third valve chamber to the side of the capacity control valve to be connected to the control chamber and a segment of said discharge-side path that extends from said third valve chamber to the side of the capacity control valve to be connected to the control chamber are formed as a common path.

7. The capacity control valve according to claim 1, wherein a pressure receiving area of said pressure sensitive body and a pressure receiving area of said third valve portion are formed equal in size;

said third valve chamber is formed closer to the side of the capacity control valve to be connected to the control chamber than said first valve chamber;

said third valve portion is provided on a side of said first valve portion that is opposite to said second valve portion, and said first valve portion is disposed between said second valve portion and said third valve portion so as to extend from said first valve chamber to said third valve chamber;

said valve body extends from said second valve portion to said third valve portion in an axial direction and forms one portion of said suction-side path; and a segment of said suction-side path that extends from said third valve chamber to the side of the capacity control valve to be connected to the control chamber and a segment of said discharge-side path that extends from said third valve chamber to the side of the capacity control valve to be connected to the control chamber are formed as a common path.

8. The capacity control valve according to claim 1, wherein said one of the engagement face of said third valve portion and the seat face of said valve seat body is formed into the rounded shape with a radius of curvature R satisfying 9 mm<R<11 mm;

a pressure receiving area of said pressure sensitive body and a pressure receiving area of said third valve portion are formed equal in size;

said third valve chamber is formed closer to the side of the capacity control valve to be connected to the control chamber than said first valve chamber;

said third valve portion is provided on a side of said first valve portion that is opposite to said second valve portion, and said first valve portion is disposed between said second valve portion and said third valve portion so as to extend from said first valve chamber to said third valve chamber;

said valve body extends from said second valve portion to said third valve portion in an axial direction and forms one portion of said suction-side path; and a segment of said suction-side path that extends from said third valve chamber to the side of the capacity control valve to be connected to the control chamber and a segment of said discharge-side path that extends from said third valve chamber to the side of the capacity control valve to be connected to the control chamber are formed as a common path.

9. The capacity control valve according to claim 5, wherein said third valve portion is formed into a shape widened from a reduced diameter shape portion to an end thereof in a direction from said first valve chamber toward said third valve chamber, and has said engagement face on an outer circumferential edge thereof; and said valve seat body is formed into a concave shape and has said seat face on an outer circumferential edge thereof.

10. The capacity control valve according to claim 6, wherein said third valve portion is formed into a shape widened from a reduced diameter shape portion to an end thereof in a direction from said first valve chamber toward said third valve chamber, and has said engagement face on an outer circumferential edge thereof; and said valve seat body is formed into a concave shape and has said seat face on an outer circumferential edge thereof.

11. The capacity control valve according to claim 7, wherein said third valve portion is formed into a shape widened from a reduced diameter shape portion to an end thereof in a direction from said first valve chamber toward said third valve chamber, and has said engagement face on an outer circumferential edge thereof; and said valve seat body is formed into a concave shape and has said seat face on an outer circumferential edge thereof.

12. The capacity control valve according to claim 8, wherein said third valve portion is formed into a shape widened from a reduced diameter shape portion to an end thereof in a direction from said first valve chamber toward said third valve chamber, and has said engagement face on an outer circumferential edge thereof; and said valve seat body is formed into a concave shape and has said seat face on an outer circumferential edge thereof.

13. The capacity control valve according to claim 9, wherein a pressure receiving area of said third valve portion is set larger than a pressure receiving area of said first valve portion.

14. The capacity control valve according to claim 10, wherein a pressure receiving area of said third valve portion is set larger than a pressure receiving area of said first valve portion.

15. The capacity control valve according to claim 11, wherein a pressure receiving area of said third valve portion is set larger than a pressure receiving area of said first valve portion.

16. The capacity control valve according to claim 12, wherein a pressure receiving area of said third valve portion is set larger than a pressure receiving area of said first valve portion.

17. The capacity control valve according to claim 1, wherein an effective diameter $\phi b$ of said pressure sensitive body and a seal diameter $\phi r1$ of said third valve portion are formed so as to satisfy $0.8<\phi r1/\phi b<1.0$.

18. The capacity control valve according to claim 1, wherein the second valve chamber is formed in the middle of said suction-side path, and the first valve chamber is formed in the middle of said discharge-side path.

* * * * *